US005502964A

United States Patent [19]

Polzl et al.

[11] Patent Number: 5,502,964

[45] Date of Patent: Apr. 2, 1996

[54] EXHAUST SYSTEM

[75] Inventors: Hans-Werner Polzl, Bad Wimpfen; Xaver Stemmer, Reichertshofen; Clemens Bandel, Ingolstadt, all of Germany

[73] Assignee: Audi AG, Germany

[21] Appl. No.: 323,049

[22] Filed: Oct. 14, 1994

[30] Foreign Application Priority Data

Oct. 16, 1993 [DE] Germany ..... 43 35 357.6

[51] Int. Cl.[6] ..... F01N 7/10

[52] U.S. Cl. ..... 60/323; 123/55.1

[58] Field of Search ..... 60/323; 123/54.1, 123/54.8, 55.1

[56] References Cited

U.S. PATENT DOCUMENTS 2,722,923 11/1955 Morissette ..... 123/55.1

3,768,248 10/1973 Grgurich ..... 60/323

FOREIGN PATENT DOCUMENTS 2283851 11/1990 Japan ..... 123/55.1

3124915 5/1991 Japan ..... 123/55.1

128934 12/1921 United Kingdom ..... 123/55.1

*Primary Examiner*—Douglas Hart

*Attorney, Agent, or Firm*—Lalos & Keegan

[57] ABSTRACT

The invention relates to an exhaust system for a W-12 reciprocating piston internal combustion engine with three rows of cylinders of four cylinders each, with outlet channels connected to the exhaust lines, in which there are two separate exhaust runs to which two cylinders per row of cylinders are connected in order to achieve a functional, structurally favorable system.

7 Claims, 2 Drawing Sheets

EXHAUST SYSTEM

The invention relates to an exhaust system for a W-12 reciprocating piston internal combustion engine with three rows of cylinders of four cylinders each.

Internal combustion engines of the generic type are characterized by a compact construction with high power density, however require high construction and control engineering cost for the exhaust system and engine control in order to achieve the legally stipulated low exhaust emission values.

The problem of the invention is to propose an exhaust system for generic W-12 internal combustion engines which is advantageous in terms of function and control engineering at reasonable construction cost.

This problem is solved according to the invention.

According to the invention there are two exhaust runs to which two cylinders of the internal combustion engine per row of cylinders are connected. This yields a double six cylinder distribution, in which the entire engine control with the connected lambda control can be accordingly made double. This results in a functionally easily manageable motor control which also allows consumption-optimized operation of the internal combustion engine only as a six cylinder engine with only low power requirements. Moreover, an exhaust system split in this way is advantageously simplified both with respect to mounting on the internal combustion engine and also placement of the piping system on the motor vehicle.

The cylinders per row of cylinders can be connected especially feasibly to the yoke-shaped manifold sections which are located on the front of the internal combustion engine and which are connected to the continuing exhaust system with a three-way catalytic converter. Preferably in addition the yoke-shaped exhaust sections can be structurally combined into a double-flow exhaust manifold.

In the stipulated ignition sequence the indicated cylinders can be connected to one manifold section and the other cylinders can be connected to the other manifold section. This enables good tuning with respect to the power of the internal combustion engine with pressure pulsations or exhaust emissions which are uniformly distributed over time.

One structurally favorable placement of the exhaust lines from the outlet channels of the cylinder heads of the internal combustion engine to the exhaust manifold is also engendered by the features disclosed. It is proposed at the same time that these exhaust lines be made heat-insulated in a conventional manner in order to prevent unwanted heatup in the engine vicinity and to ensure prompt response of exhaust neutralization.

Figure 3:
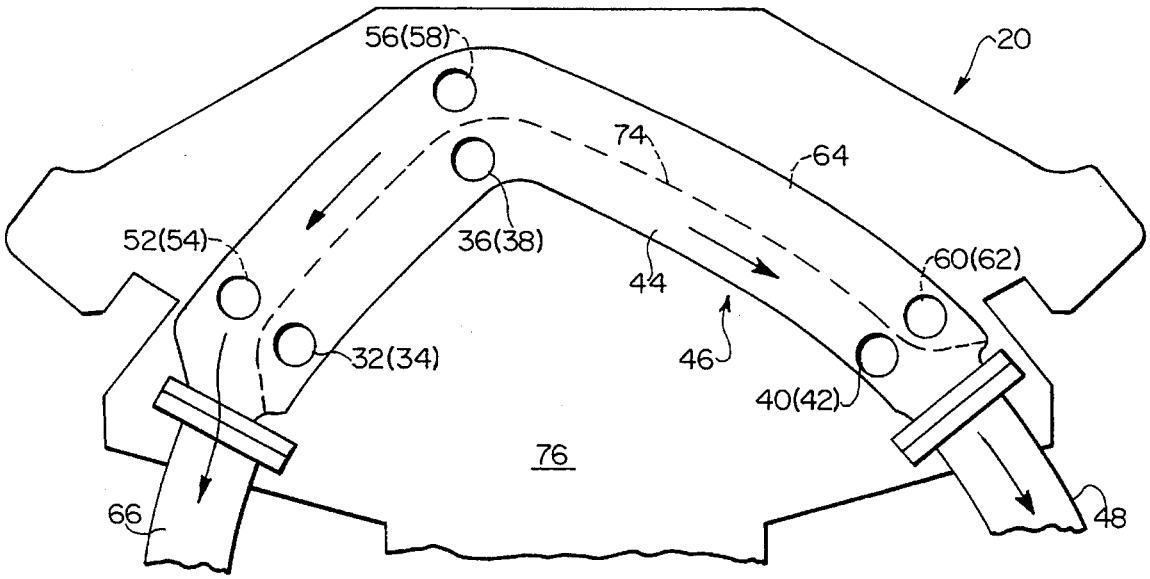
Figure 2:
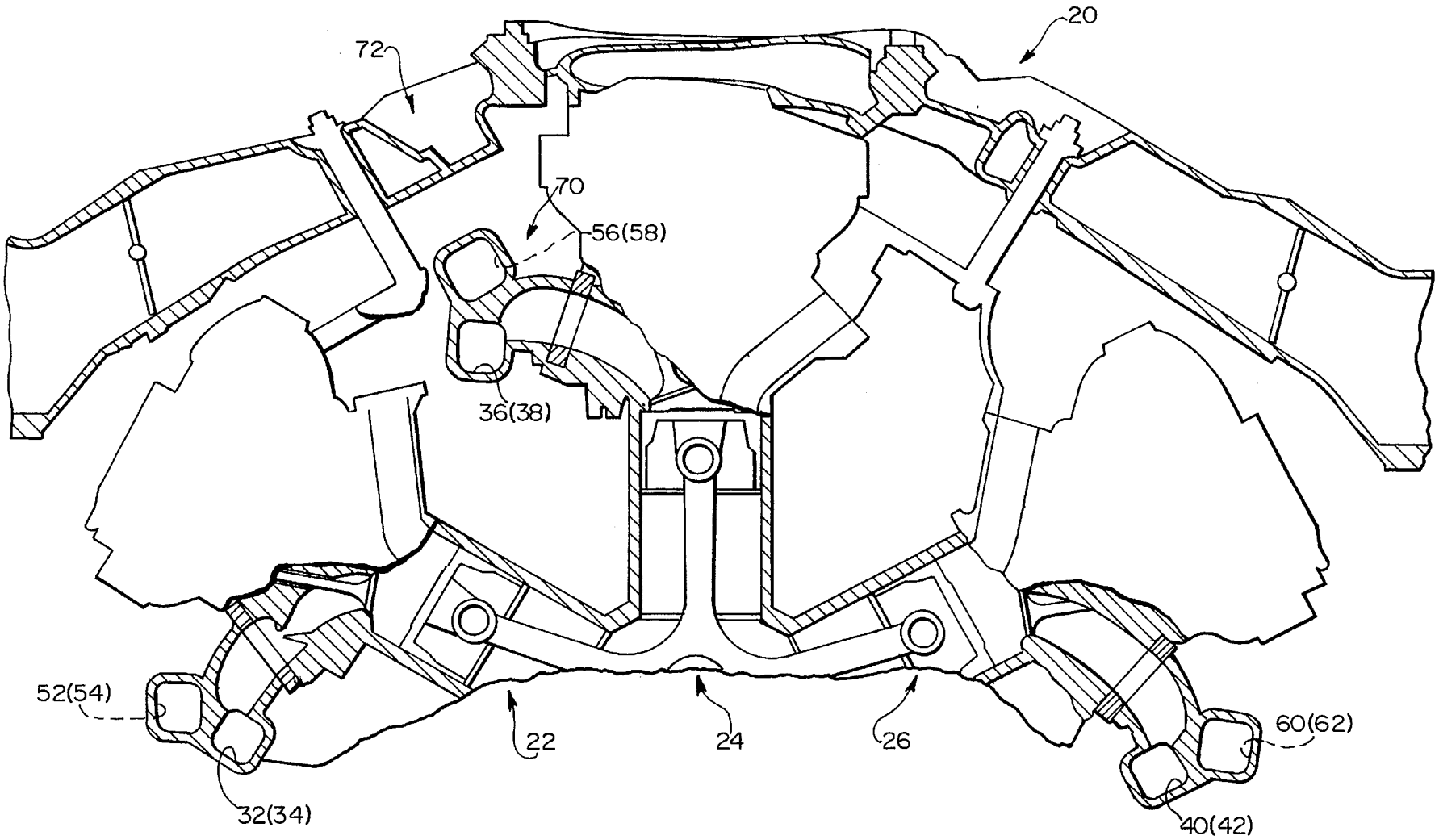

One embodiment of the invention is more closely explained in the following with further details. The attached drawing shows in FIG. 1 a block diagram of an exhaust system for a W-12 reciprocating piston internal combustion engine with two separate exhaust runs;

FIG. 2 shows a cross section through a partially shown W-12 reciprocating piston internal combustion engine with an arrangement of the exhaust lines emerging from the outlet channels of the internal combustion engine; and FIG. 3 shows a schematic view of the front of the internal combustion engine with added yoke-shaped exhaust manifold.

Figure 1:
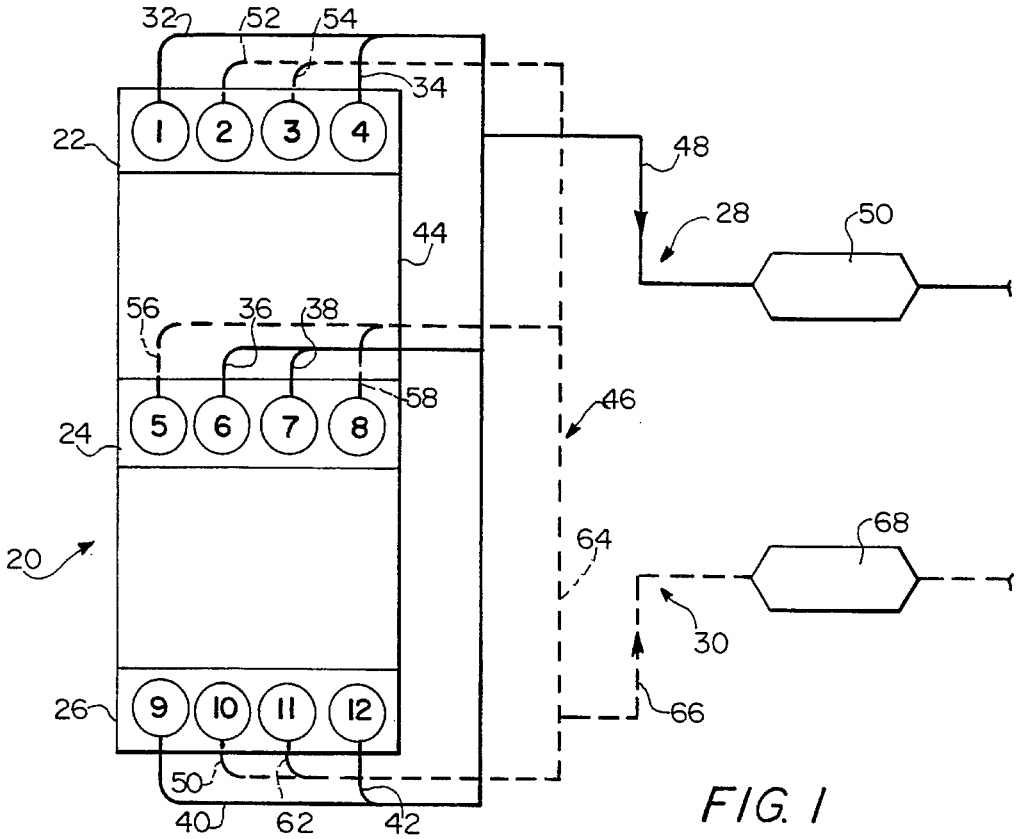

The W-12 four-cycle reciprocating piston internal combustion engine 20 shown in FIGS. 1 through 3 has three rows of cylinders 22, 24, 26 in a W-configuration with four cylinders each (numbering from 1 to 12). As FIG. 2 shows, the middle row of cylinders 24 in the embodiment is arranged vertically, while the outside rows of cylinders 22, 26 are aligned peripherally offset by 60° to the middle row of cylinders 24.

The exhaust system is divided into two exhaust runs (compare FIG. 1) 28, 30, the one exhaust run 28 being connected to cylinders 1 and 4 of row of cylinders 22, to cylinders 6 and 7 of the middle row of cylinders 24, and to cylinders 9 and 12 of the third row of cylinders 26. The exhaust run 30 is accordingly connected to the still remaining cylinders 2 and 3, 5 and 8, and 10 and 11 of cylinder rows 22, 24, 26.

Exhaust run 28 is composed of exhaust lines 32, 34, 36, 38, 40, 42 which connect to the outlet channels in the cylinder heads of the internal combustion engines (of convention design if not described) and which discharge into a manifold section 44 of a common exhaust manifold 46. From manifold section 44 on the outlet side a preliminary tailpipe branches, into which conventionally a lambda probe which is not shown is inserted and which is connected to a three-way catalytic converter 50. Via the three way catalytic converter the exhaust flows to the remaining exhaust system of the internal combustion engine which can be of conventional design and which therefore is not shown.

The exhaust run 30 has in the same way two exhaust lines 52, 54 on the first row of cylinders 22, two exhaust lines 56, 58 on the middle row of cylinders 24 and two exhaust lines 60, 62 on the third row of cylinders 26 which discharge into the second manifold section 64 of the exhaust manifold 46. A second preliminary tailpipe 66 which is connected to a second catalytic converter 68 emerges from this manifold section 64.

In an ignition sequence of the W-12 internal combustion engine of 1-8-9-3-6-11-4-5-12-2-7-10 the exhaust lines of the one exhaust run 28 are connected to cylinders 1 and 4 of one row of cylinders 22, to cylinders 6 and 7 of the middle row of cylinders 24 and to cylinders 9 and 12 of the third row of cylinders 26, while the other cylinders are connected to the second exhaust run 30 as described above.

As FIG. 2 shows, exhaust lines 36, 38 and 56, 58 are located in a free space which is formed between the two rows of cylinders 22, 24 and which is overlapped by one line section 72 of the intake system of the internal combustion engine which is not detailed.

Exhaust lines 32, 24 and 52, 54 of the left outside row of cylinders 22 and exhaust lines 40, 42 and 60, 62 of the right outside row of cylinders 26 are each roughly vertical under the it cylinder heads, by which an arrangement of the exhaust lines which is favorable with respect to the installation space is engendered.

These exhaust lines discharge, as FIG. 3 shows, as described above, in the yoke-shaped exhaust manifold 46 which is made double-flow divided by a bulkhead and which is placed on the power-delivering front 76 of the internal combustion engine. Preliminary tailpipes 48, 66 of the separate exhaust runs 28, 30 are connected to the double-flow exhaust manifold 46.

As can be seen especially from FIG. 2, exhaust lines 32, 34, 36, 38, 40, 42 as well as 52, 54, 56, 58, 60, 62 are provided with heat insulation (double-walled with inserted insulating pads). In the same way the exhaust manifold 46 and preliminary tailpipes 48, 66 are insulated up to catalytic converters 50, 68.

There is one lambda probe per preliminary tailpipe which is connected conventionally in terms of control engineering to the double engine control provided for each six cylinders.

We claim:

1. Exhaust system for a W-12 reciprocating piston internal combustion engine with three rows of cylinders of four cylinders each, with outlet channels connected to the exhaust lines, wherein two separate exhaust runs (28, 30) are provided to which two cylinders per row of cylinders (22, 24, 26) are connected.

2. Exhaust system as claimed in claim 1, wherein on one face (76) of the internal combustion engine (2) there are yoke-shaped manifold sections (44, 64) into which the exhaust lines of the combined cylinders discharge and from which at least one preliminary tailpipe each (48, 66) emerges.

3. Exhaust system as claimed in claims 1 or 2, wherein the two yoke-shaped manifold sections (44, 64) are combined into a double-flow exhaust manifold (46).

4. Exhaust system as claimed in claim 3, wherein in an ignition sequence of the internal combustion engine of 1-8-9-3-6-11-4-5-12-2-7-10 cylinders 1-4, 6-7 and 9-12 are connected to one manifold section (44) and the other cylinders are connected to the other manifold section (64).

5. Exhaust system as claimed in claim 4, wherein exhaust lines (36, 38 or 56, 58) of the middle row of cylinders (24) are located within the free space which is bounded by one outside row of cylinders (22) and which is overlapped by an intake line section (72).

6. Exhaust system as claimed in claim 5, wherein the outlet lines (32, 34, 52, 54 and 40, 42, 60, 62) emerging from the outlet channels of the outside rows of cylinders (22, 26) run under the corresponding cylinder heads for a vertical arrangement of the middle row of cylinders (24) and at a 60° cylinder row offset.

7. Exhaust system as claimed in claim 6, wherein at least the exhaust lines and the yoke-shaped exhaust manifold are made heat insulated.

* * * * *